US008511932B2

(12) United States Patent
Jurasz et al.

(10) Patent No.: US 8,511,932 B2
(45) Date of Patent: Aug. 20, 2013

(54) ROAD CONSTRUCTION MACHINE, LEVELING DEVICE, AS WELL AS METHOD FOR CONTROLLING THE MILLING DEPTH OR MILLING SLOPE IN A ROAD CONSTRUCTION MACHINE

(71) Applicants: Wirtgen GmbH, Windhagen (DE); Silvia Tewes, Unkel/Rhein (DE)

(72) Inventors: Jaroslaw Jurasz, Windhagen (DE); Günter Hähn, Königswinter (DE); Günter Tewes, Unkel (DE);

(73) Assignee: Wirtgen GmbH (DE)

( * ) Notice: Subject to any disclaimer, the term of this patent is extended or adjusted under 35 U.S.C. 154(b) by 0 days.

(21) Appl. No.: 13/671,786

(22) Filed: Nov. 8, 2012

(65) Prior Publication Data

US 2013/0099551 A1 Apr. 25, 2013

Related U.S. Application Data

(63) Continuation of application No. 13/098,798, filed on May 2, 2011, now Pat. No. 8,308,395, which is a continuation of application No. 12/225,792, filed as application No. PCT/EP2007/053590 on Apr. 12, 2007, now Pat. No. 7,946,788.

(30) Foreign Application Priority Data

Apr. 27, 2006 (DE) ..... 10 2006 020 293

(51) Int. Cl.
*E01C 23/088* (2006.01)

(52) U.S. Cl.
USPC ..... 404/75; 404/84.1

(58) Field of Classification Search
CPC ..... E01C 23/088
USPC ..... 404/75, 84.1
See application file for complete search history.

(56) References Cited

U.S. PATENT DOCUMENTS

| | | | |
|---|---|---|---|
| 4,140,420 | A | 2/1979 | Swisher, Jr. et al. |
| 4,186,968 | A | 2/1980 | Barton |
| 4,270,801 | A | 6/1981 | Swisher, Jr. et al. |
| 4,929,121 | A | 5/1990 | Lent et al. |
| 5,318,378 | A | 6/1994 | Lent |
| 5,378,081 | A | 1/1995 | Swisher, Jr. |
| 5,533,790 | A | 7/1996 | Weiland |

(Continued)

FOREIGN PATENT DOCUMENTS

| | | | |
|---|---|---|---|
| DE | 9204614 | U1 | 7/1992 |
| EP | 1154075 | A2 | 11/2001 |

OTHER PUBLICATIONS

English translation of Written Opinion of the International Searching Authority, PCT/EP2007/053590, Dec. 10, 2008.

*Primary Examiner* — Raymond W Addie
(74) *Attorney, Agent, or Firm* — Waddey & Patterson, P.C.; Lucian Wayne Beavers

(57) ABSTRACT

A control and switchover system is provided for controlling milling depth and/or slope of a milling drum of a road construction machine during a milling operation to create a milled surface. The system controls the milling depth and/or slope at least in part on a measurement made with a first sensor. Without interrupting the milling operation the system switches over the control of the milling depth and/or slope to control based at least in part on a measurement made with a second sensor.

19 Claims, 8 Drawing Sheets

(56) References Cited

U.S. PATENT DOCUMENTS

| | | | |
|---|---|---|---|
| 5,556,226 | A | 9/1996 | Hohmann, Jr. |
| 5,984,420 | A | 11/1999 | Murray et al. |
| 7,422,391 | B2 | 9/2008 | Holl et al. |
| 7,510,347 | B2 | 3/2009 | Lemke |
| 7,559,718 | B2 | 7/2009 | Zachman et al. |
| 2002/0192025 | A1 | 12/2002 | Johnson |
| 2004/0247388 | A1 | 12/2004 | Lloyd |
| 2008/0152428 | A1 | 6/2008 | Berning |

ROAD CONSTRUCTION MACHINE, LEVELING DEVICE, AS WELL AS METHOD FOR CONTROLLING THE MILLING DEPTH OR MILLING SLOPE IN A ROAD CONSTRUCTION MACHINE

BACKGROUND OF THE INVENTION

The invention relates to a road construction machine, a leveling device, and a method. This application is a continuation of U.S. Ser. No. 13/098,798 now U.S. Pat. No. 8,308,395, which is a continuation of U.S. Ser. No. 12/225,792 now U.S. Pat. No.7,946,788. Which is a 371 of PCT/EP 2007/053590

It is already known for road milling machines to integrate a leveling device by means of which it is to be ensured that an even milled surface can be produced.

The milling depth control system is designed in such a fashion that different sensors can be connected. Among others, the sensors used include, for example, wire-rope sensors, ultrasonic sensors and slope sensors.

A wire-rope sensor is mounted at the side plates (edge protection) next to the milling drum and thus scans the reference surface, in this case the road surface, very precisely. The ultrasonic sensor operates in a non-contact fashion and is therefore not subject to any mechanical wear and tear. It can be used in a variety of ways as it can be attached in different positions on the machine.

If a defined cross slope is to be produced, a slope sensor can also be used which is integrated into the road milling machine.

The known milling depth control system can be provided with two independent control loops. A controller is provided in each control loop to which the sensors can be connected via plug-in connectors. For example, either two height sensors are provided, or one height sensor in combination with one slope sensor.

It is unfavorable in the state of the art that the frequent change between the many different sensors, which is necessary for application-related reasons, is not possible without an interruption of the milling operation and without negative influences on the work result. To change the current sensor, the automatic mode of the control system needs to be left first as there is merely one controller, or merely one indication and setting device for set values and actual values per controller respectively. The new sensor can then be selected, and the desired set value can be set before it is possible to change back into the automatic mode of the control system. If the road milling machine continued milling during changing of the sensor, faults in the work result could occur because no control is effected during that time. The machine therefore needs to be stopped for a change of the sensor, which leads to a significant time loss. An adverse effect on the work result ensues even if the road milling machine is stopped during change of the sensor because the milling drum cuts clear when standing. This is an unwelcome effect, in particular during fine milling.

It is therefore the object of the invention to specify a road construction machine, as well as a leveling device and a method for controlling the milling depth and/or the milling slope, in which it is possible to change the sensors without any interruption of the milling operation.

SUMMARY OF THE INVENTION

The invention provides in a favorable manner that the indication and setting device of the leveling device, in addition to an indication and setting unit provided for the at least one sensor currently in use, is provided with an additional indication and setting unit for a selectable sensor which is to be exchanged for the sensor currently in use. Providing a further indication and setting unit offers the advantage that the new sensor, which is to be exchanged for a sensor currently in use, can be prepared for the time of switchover in terms of its actual and set values while the operation continues. At the time of switchover, the sensor can therefore be changed without any alteration of the currently applicable adjustment value. The leveling device is provided with a device for the switchover of sensors which, upon activation of a switchover command, effects switchover of the leveling device from the at least one current sensor to at least one pre-selected other sensor without interruption of the milling operation and without any erratic alteration of the current adjustment value for the setting of the milling depth and/or for the setting of the slope of the milling drum.

The switchover device, with the indication and setting device, enables a pre-selection of the other sensor and the pre-setting of operating parameters (set values and actual values) of the other pre-selected sensor.

In this way, a machine operator can already prepare the switchover of the sensors during the milling operation so that switchover of the sensors is possible at the push of a button without any time loss and without an interruption of the milling operation.

For this purpose, the leveling device is provided with an indication and setting device which is capable of indicating and altering the data of the current sensor and the data of the pre-selected sensor. By means of the switchover device, switching over from the current sensor to the pre-selected sensor can be effected during the milling operation without any repercussion on the work result.

One embodiment of the invention provides that the currently measured actual value for the milling depth and/or for the slope of the milling drum of the at least one pre-selected other sensor can be set, latest at the time of switchover, to the same, last measured actual value for the milling depth and/or for the slope of the previously used sensor.

It is therefore possible, when changing the sensor, to apply the actual value of the sensor last used, so that the adjustment value for the setting of the milling depth and/or for the setting of the slope of the milling drum is not altered on account of the change, and that the evenness of the milled road surface is not adversely affected by the change of the sensor.

An alternative embodiment provides that the set value for the milling depth and/or for the slope of the milling drum can be set, latest at the time of switchover, to the currently measured actual value for the milling depth of the at least one pre-selected sensor.

Equating the set value to the currently measured actual value of the pre-selected sensor which will replace the previous sensor ensures that no alteration of the adjustment value for the setting of the milling depth and/or the slope will be made at the time of switchover.

A third embodiment provides that, in case of a deviation of the measured actual values of the selected other sensor from the previously used sensor, the adjustment value for the setting of the milling depth and/or the setting of the slope can be altered by means of a pre-seeable transition function.

According to a further alternative, it is therefore provided that, in case that an alteration of the current adjustment value results on account of the switchover of the sensors, said alteration follows a pre-setable transition function starting from an adjustment value of 0. It is thereby achieved that the alteration of the adjustment value is not effected in an erratic fashion, so that the evenness of the milled road surface is not adversely affected and adaptation to the adjustment value resulting on account of the switchover is effected over a longer distance, for example, over 10 m or more.

It is preferably provided that the leveling device is provided with two controllers, the sensors of which are arranged parallel to the rotating axis of the milling drum at a lateral distance to one another, and which preferably control the milling depth independently of one another on the left and right side of the machine.

According to the method for controlling the milling depth or the milling slope of the milling drum of a road construction machine by registering the current actual value of the milling depth and/or of the slope of the milling drum relative to a reference surface using at least one exchangeable or switchable sensor, where a milling depth control and/or a slope control of the milling drum is effected conditional on pre-determined set values and currently measured actual values during the milling operation by returning an adjustment value for achieving or maintaining the set value, it is provided that, when exchanging a currently used sensor for a pre-selected other sensor, control of the milling depth and/or the slope is effected without interruption of the milling operation by setting the set values and actual values of the sensor, prior to switchover, by means of an additional indication and setting unit in such a fashion that the current adjustment value for the setting of the milling depth and/or for the setting of the slope of the milling drum is not altered in an erratic fashion.

Upon activation of a switchover command for the switchover of sensors, the control is effected without an interruption of the milling operation and without an erratic alteration of the current adjustment value for the setting of the milling depth and/or for the setting of the slope of the milling drum.

The road surface or a defined horizontal plane pre-determined, for instance, by a laser, or any other freely definable pre-selected surface can be used as reference surface, which may show a different slope or gradient (positive or negative) in the course of the road surface.

In the following, embodiments of the invention are explained in more detail with reference to the drawings.

DESCRIPTION OF THE PREFERRED EMBODIMENTS OF THE DRAWINGS

Figure 1:
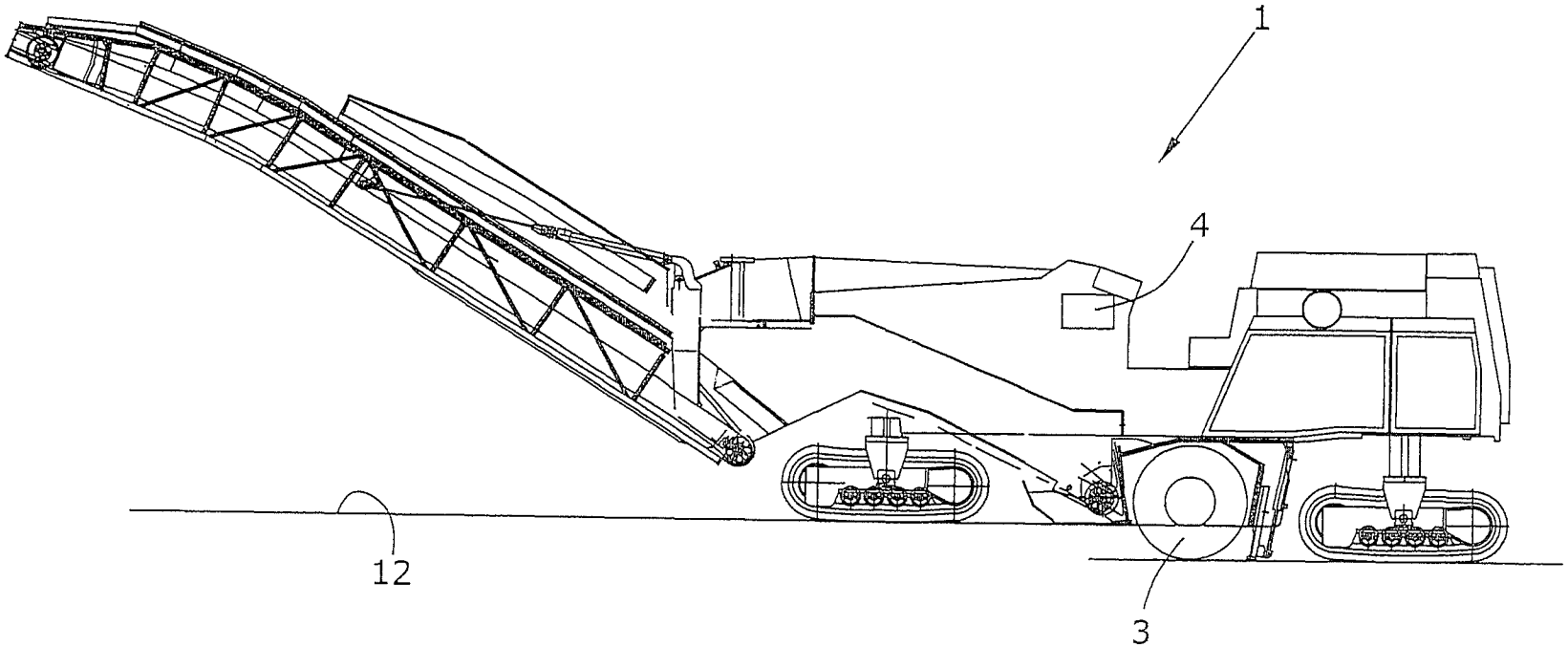
FIG. 1 shows a road construction machine.

FIG. 1 shows a road machine 1 for the treatment of road surfaces with a milling drum 3 height-adjustable with regard to the milling depth. The front travel drive unit supports itself on, for instance, the road surface 12, which can serve as reference surface for a milling depth control or slope control. For this purpose, the road machine 1 is provided with a leveling device 4 with at least one controller 6*a*, 6*c* which receives set values for the milling depth and/or the slope of the milling drum 3. Exchangeable sensors A, B, C can be connected to the controllers 6*a*, 6*c* of the leveling device 4. The sensors A, B, C serve the purpose of registering the current actual value of the milling depth and/or the slope of the milling drum 3 relative to a reference surface, which may consist in the road surface 12, a pre-determined horizontal plane or a freely definable, for instance, mathematically pre-determined plane or surface.

The at least one controller 6*a*, 6*c* effects a milling depth control and/or a slope control for the milling drum 3 conditional on pre-determined set values and the currently measured actual values of the at least one sensor A, B, C, with an adjustment value being returned for achieving or maintaining the set value in the milling operation. As follows from FIG. 2, the leveling device 4 is provided with an indication and setting device which is divided into three nearly identical indication and setting units 2*a*, 2*b*, 2*c*. The indication and setting device 2 serves the purpose of setting operating parameters for the sensors A, B, C. Set values and actual values of the sensors A, B, C can be set in each indication and setting unit 2*a*, 2*b*, 2*c*. The indication and setting units 2*a* and 2*c* right and left are each connected to a controller 6*a*, 6*c* which can be activated by means of an automatic button to effect the corresponding control automatically. The controllers remain in automatic mode during switchover. The adjustment value of the controllers 6*a*, 6*c* resulting from the difference of the set value and actual value is indicated qualitatively by arrows 14, with the indication unit being capable of indicating the vertical traverse speed of the machine proportionally, meaning quantitatively, as well. The pre-determined set values and actual values of the central indication and setting unit 2*b*, which is coupled to a selectable sensor B that is to be exchanged for the currently used sensor A or C, can be interchanged, by means of a switchover device 10*a* or 10*b*, with the set values and actual values of the sensor A or C that is to be exchanged for a selectable other sensor B.

The embodiment shows a version in which one controller each 6*a*, 6*c* is provided for one side of the road construction machine 1. It is understood that the indication and setting device 2 may also be provided with merely two indication and setting units if merely one controller is present, where one sensor is exchanged for another selectable sensor.

The number of indication and setting units provided is therefore always larger by one than the number of the sensors in use.

Figure 2:
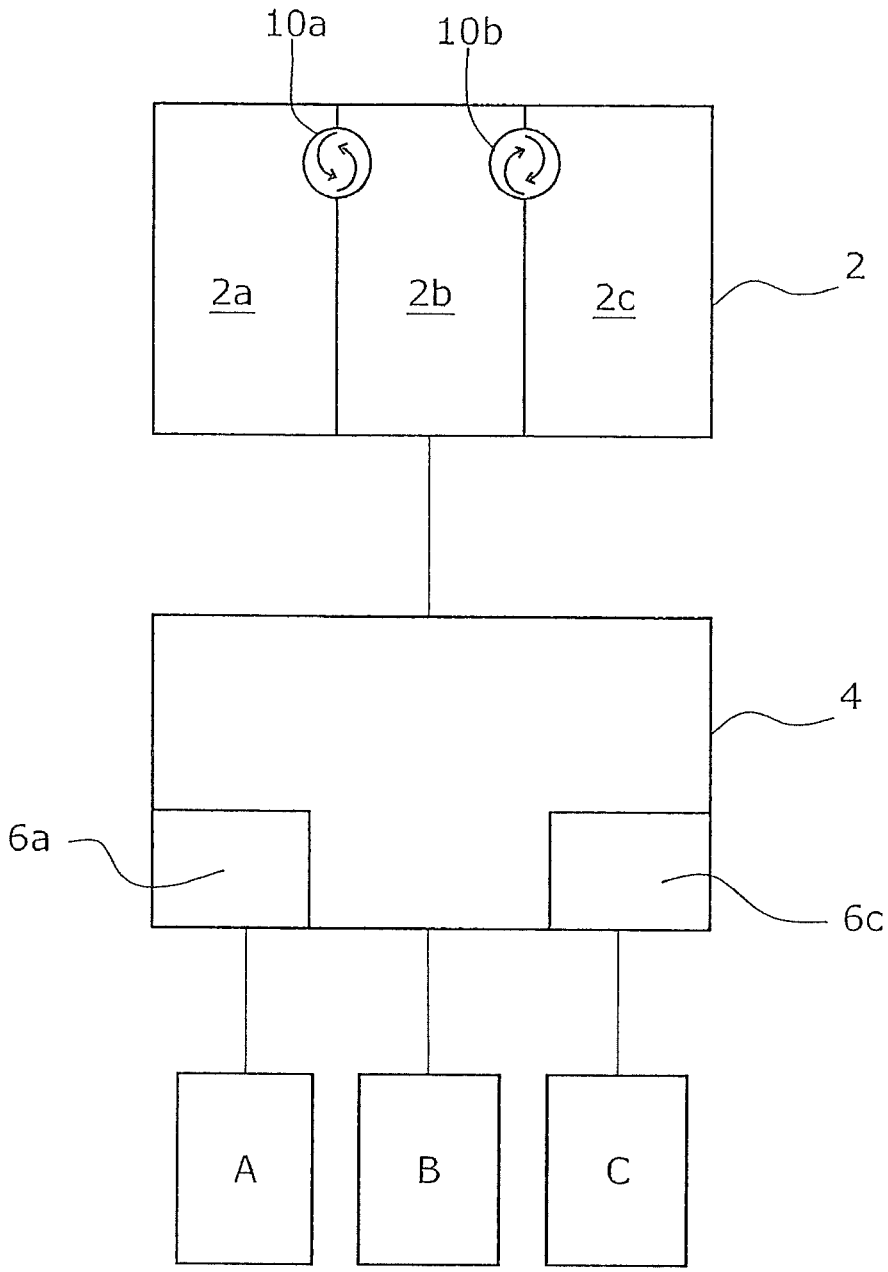
FIG. 2 shows a leveling device.

FIG. 2 shows the connection of sensors A, B, C to the leveling device 4 with two controllers 6*a*, 6*c*, where the leveling device is provided with an indication and setting device 2 with three indication and setting units 2*a*, 2*b*, 2*c*.

Figure 3:
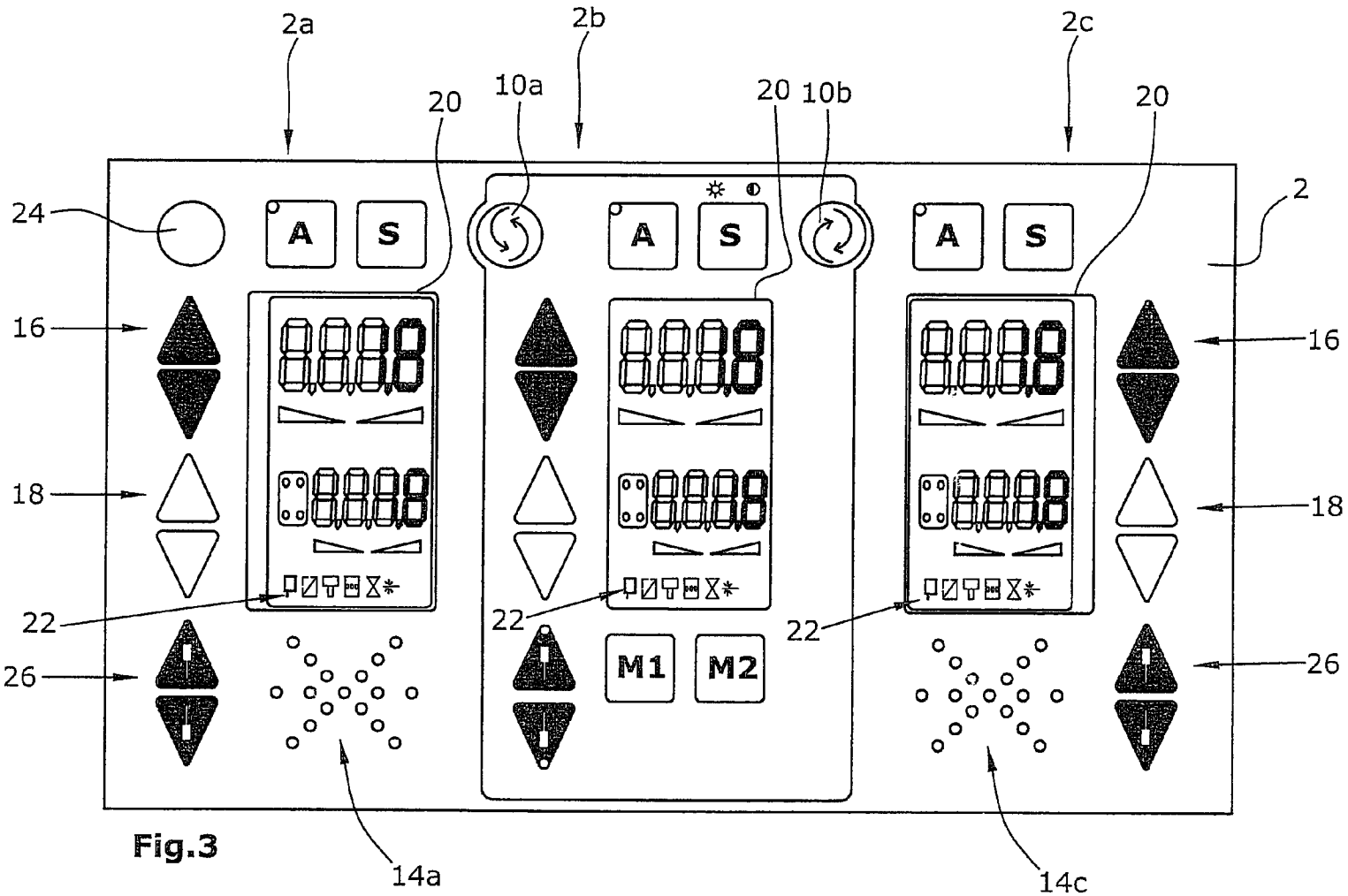
FIG. 3 shows an indication and setting device.

FIG. 3 shows an embodiment of the indication and setting device 2, wherein setting buttons 16 (up and down) for the setting of set values, as well as setting buttons 18 (up and down) for the adjustment of measured actual values are present for each indication and setting unit 2*a*, 2*b*, 2*c*.

The currently adjusted set values and the currently measured actual values of the sensors A, B, C are indicated on the displays 20 of the indication and setting units 2*a*, 2*b*, 2*c*. The direction of a possibly set slope of the milling drum can also be indicated on the displays 20. Furthermore, units are indicated, for example, in inch or cm, or percentages in % relating to the value indicated.

A choice of sensors is indicated at the lower end 22 of the display 20, enabling a machine operator to determine by means of the current indication as to which type of sensor is currently indicated on the indication and setting unit 2*a*, 2*b*, 2*c*. The symbols represent, from left to right, a wire-rope sensor, a slope sensor, an ultrasonic sensor, a multiplex sensor, a total station, as well as a laser for pre-determining the reference surface.

Above the displays 20, one button each is provided for the automatic mode and for the setting mode to set the controller parameters. A horn 24, as well as buttons 26 for adjusting the height of the travel drive unit may also be provided on the indication and setting device 2. Two memory buttons M1, M2 for memorizing set values are additionally provided below the display 20 on the central indication and setting unit 2*b*.

Figure 4:
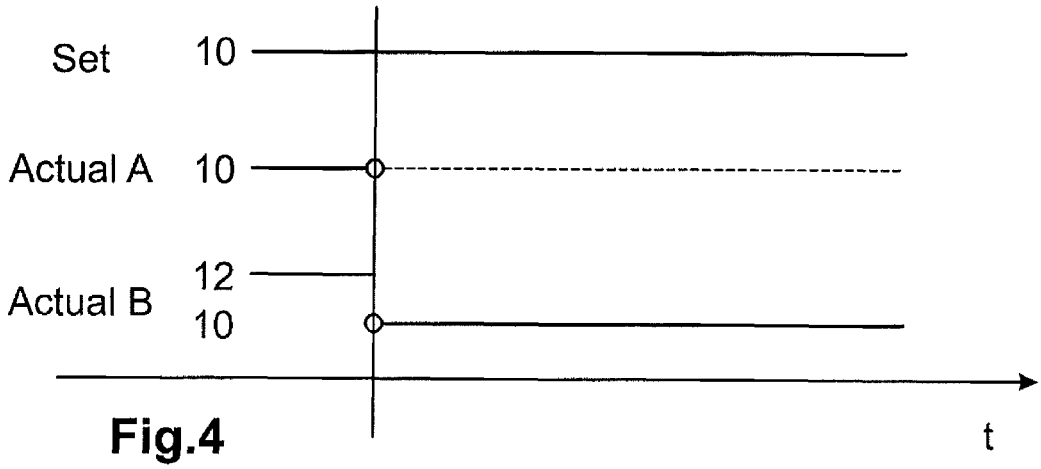
FIG. 4 shows a matching of the actual values of different sensors at switchover.
Figure 5:
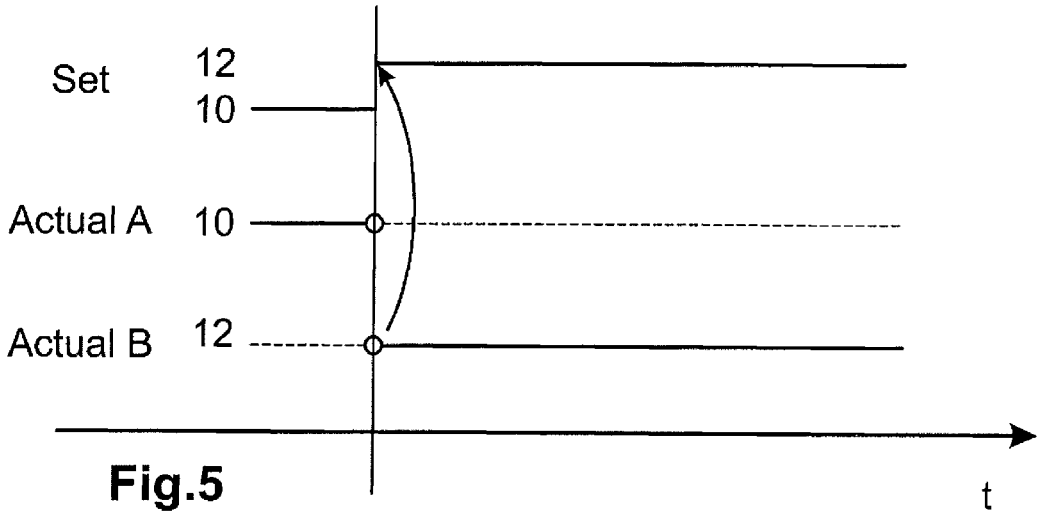
FIG. 5 shows a matching of the set value to the actual value of a new sensor at switchover.

Various possibilities of how to avoid an erratic alteration of the current adjustment value are explained in FIGS. 4 to 6.

In the embodiment of FIG. 4, the measured actual value of the pre-selected sensor B is equated to the last measured current actual value of the previously used sensor A at the time of switchover.

In FIG. 5, the pre-determined set value is adapted to the currently measured actual value of the pre-selected sensor B so that, also in this case, there is no alteration of the adjustment value.

In case of a deviation of the measured actual values of the previously used sensor A from the pre-selected new sensor B, the adjustment value can, as an alternative to the embodiments of FIGS. 4 and 5, also change into the adjustment value that results on account of the differences in the actual values by means of a transition function. A temporal transition therefore takes place by means of which no erratic alteration of the adjustment value can occur.

Figure 6A:
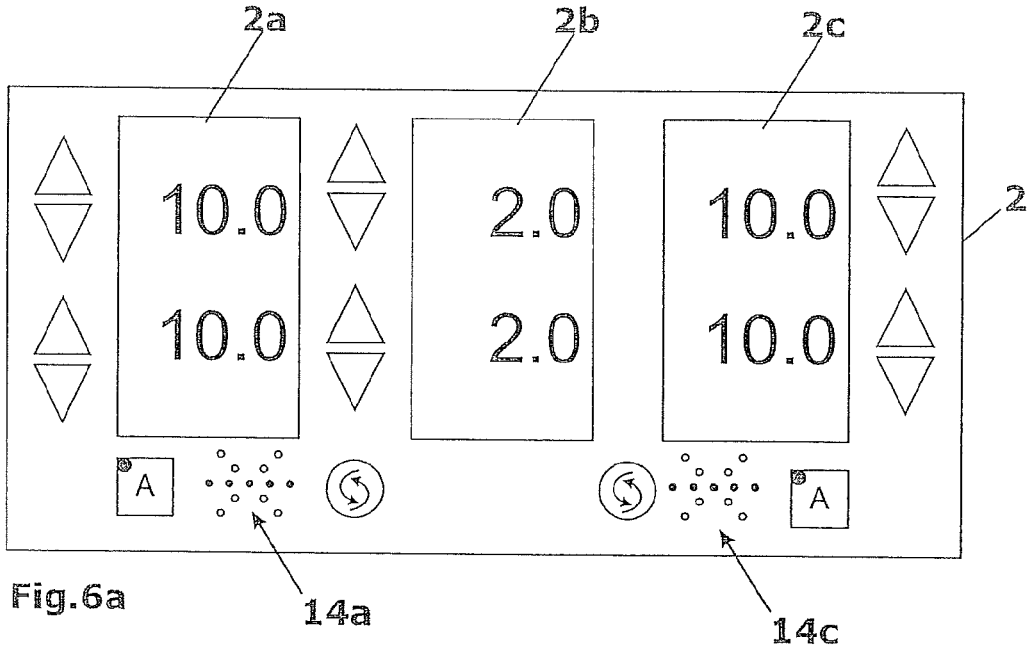
FIG. 6*a* and FIG. 6*b* shows the change from a milling depth control to a milling slope control.
Figure 6B:
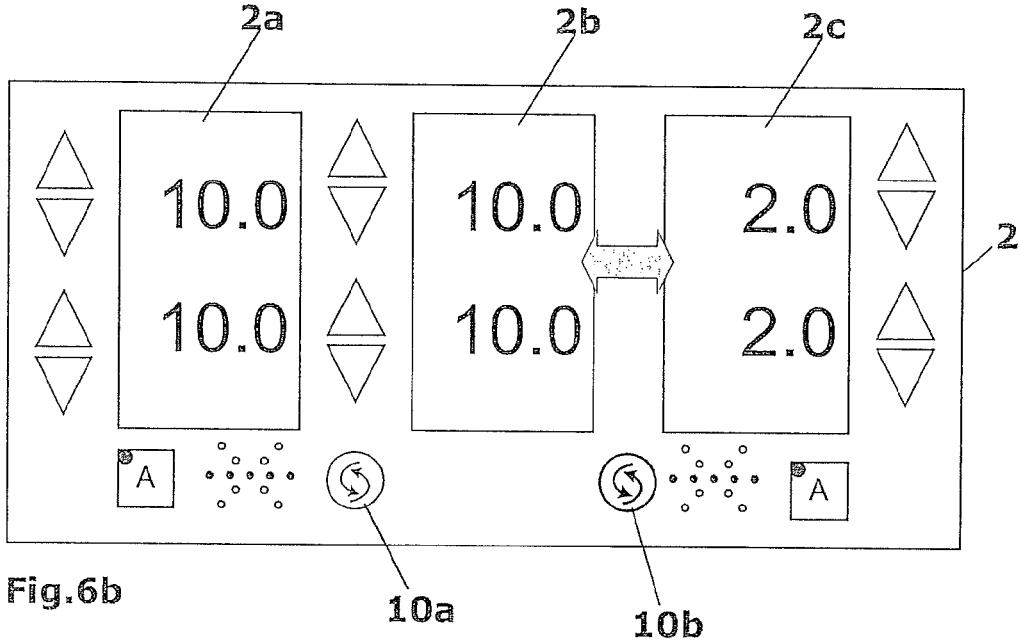

FIGS. 6*a* and 6*b* show a switchover procedure in compensated condition. FIG. 6*a* shows the initial situation in which the indication and setting unit 2*c*, which is linked to the controller 6*c*, is to be switched over from the operating mode milling depth (set value 10.0 cm) to the operating mode milling slope (set value 2%). Switchover takes place in compensated condition. This means that the respective actual value on both sides of the machine corresponds to the set value, and that the adjustment value is therefore 0 on both sides. The compensated condition is indicated by the indication and setting device 14*a*, 14*c* through a horizontal bar. It is evident from FIG. 6*b* that, when actuating the switchover button 10*b* of the switchover device 10, the pre-selected set values and actual values are interchanged from the indication and setting unit 2*b* to the indication unit 2*c*, and are taken as the basis in continued automatic mode for a mixed milling depth and milling slope control.

Figure 7A:
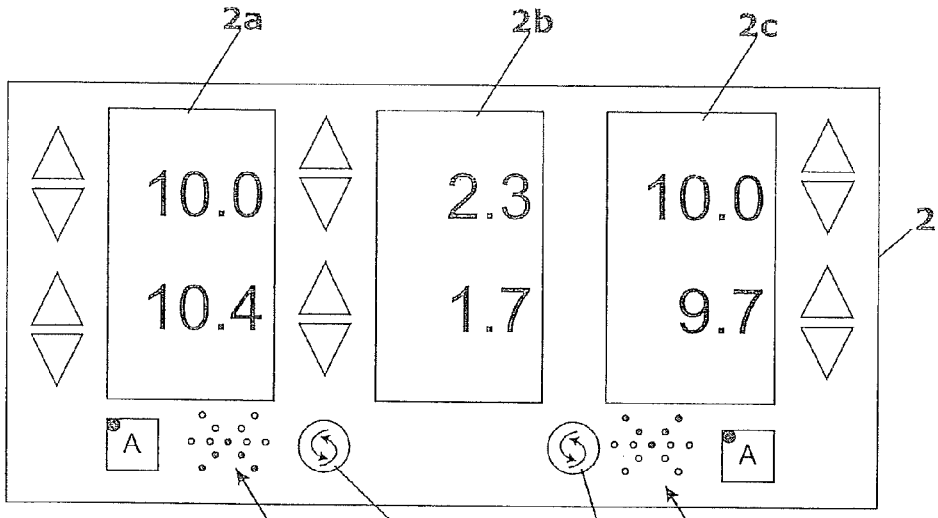
FIG. 7*a* through FIG. 7*c* shows the switchover procedure with matching of the set values.
Figure 7B:
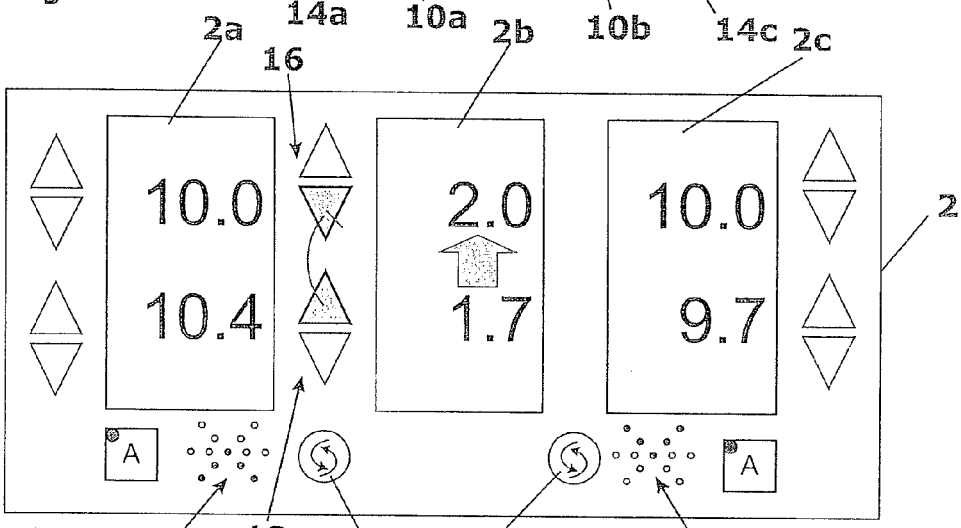
Figure 7C:
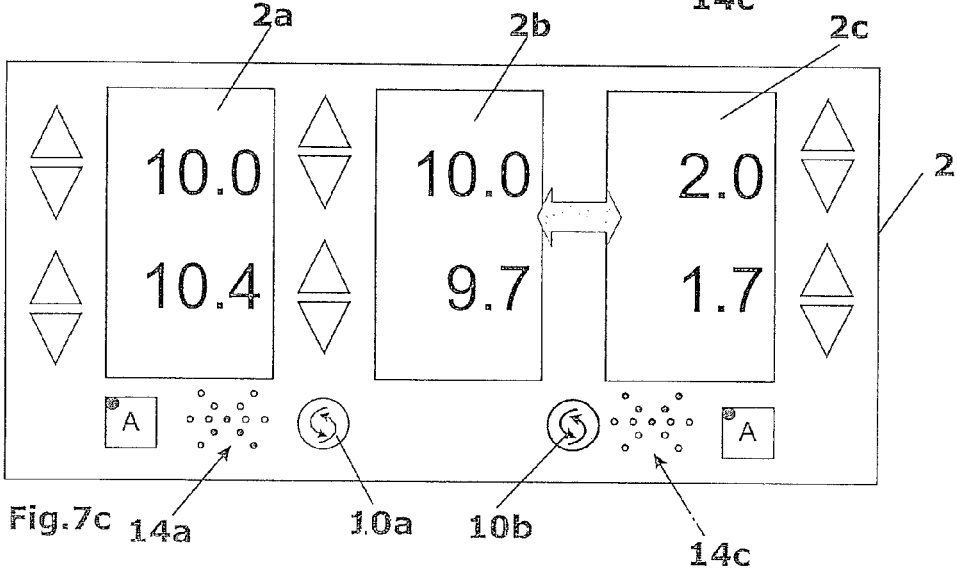

FIGS. 7*a* to 7*c* show the switchover procedure with matching of the set values.

In this example, the adjustment values on both sides of the machine are unequal 0. The indication and setting unit 2*c* of the controller 6*c* is switched over from milling depth control to milling slope control. The set value of the slope is adapted manually in FIG. 7*b* by actuating the buttons 16, so that no erratic alteration of the adjustment value will occur. It is assumed in this example that the adjustment value is proportional to the control deviation (P controller), and that the proportionality factor for the milling depth and milling slopes is equal numerically. The control deviation is 0.3 cm for the milling depth (indication and setting unit 2*c* in FIG. 7*a*), and 0.6% for the milling slope (indication and setting unit 2*b* in FIG. 7*a*) so that the adjustment value would therefore double in terms of value after switchover. In order to match the control deviation, the set value of the slope is reduced to 2.0, which results in an equal control deviation numerically. This can be effected manually via the button 16 "reduce set value", or automatically, for example, via the button combination 16, 18 "increase actual value and reduce set value" (FIG. 7*b*).

By actuating the switchover button 10*b* in the illustration according to FIG. 7*c*, the set value and actual value of the milling slope is applied, as indicated by arrows in FIG. 7*c*. In this process, the adjustment value remains unchanged.

An additional embodiment not shown may provide automatic matching of the set values. In such an embodiment, the alteration of the set values in the embodiment of FIGS. 7*a* to 7*c* mentioned before is effected automatically when the switchover button 10*b* (or 10*a*) is actuated in automatic mode. The first step of the manual alteration of the values in the central indication and setting unit 2*b* (FIG. 7) can then be dispensed with as it is effected automatically.

A further variant not shown consists in altering, in case of a deviation of the actual values, the adjustment value by means of a pre-set transition function, starting from the current adjustment value.

Figure 8A:
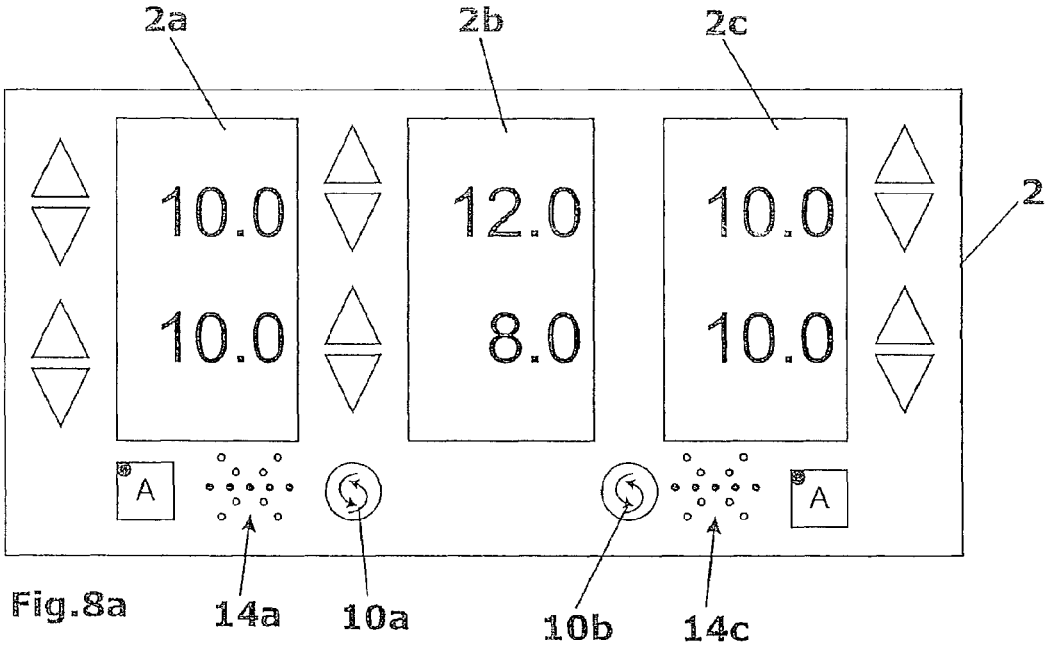
FIG. 8*a* to FIG. 8*d* shows a switchover with matching of the actual and set values.
Figure 8B:
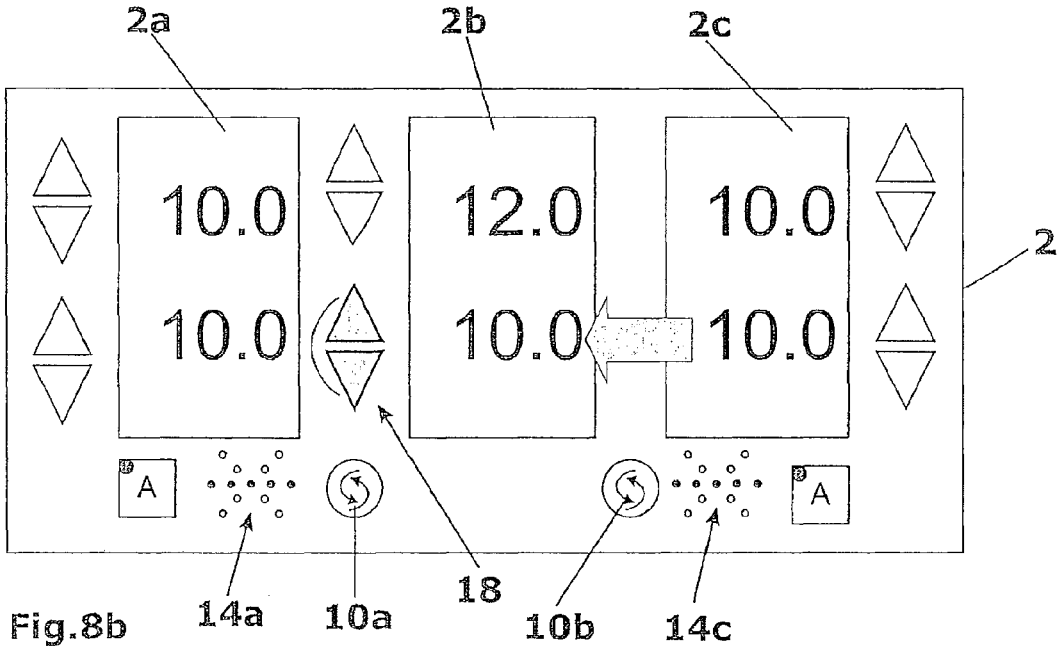
Figure 8C:
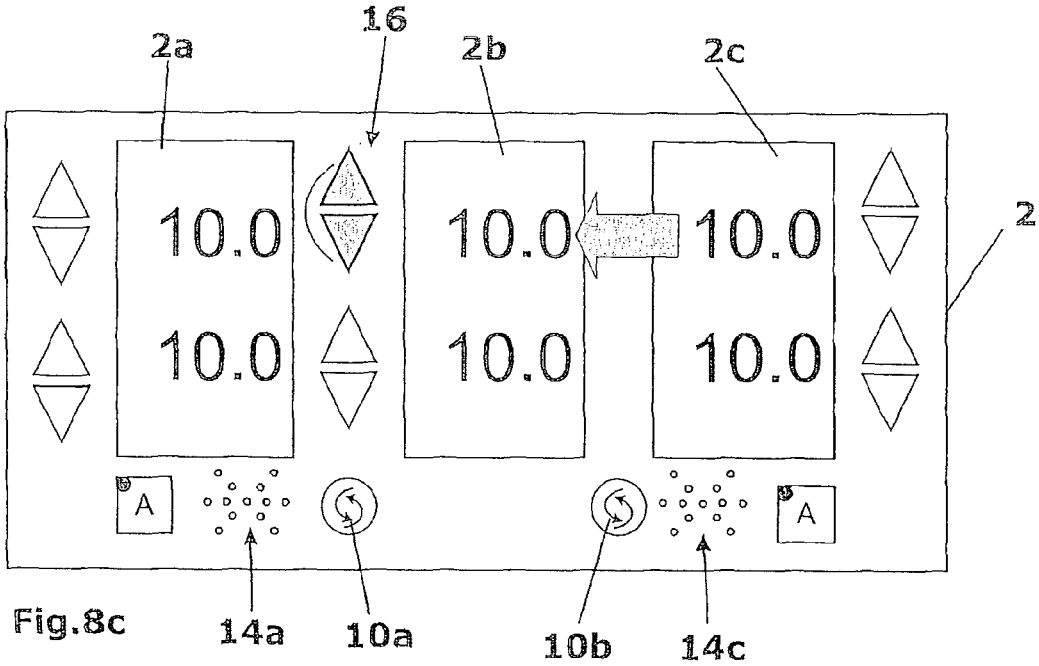
Figure 8D:
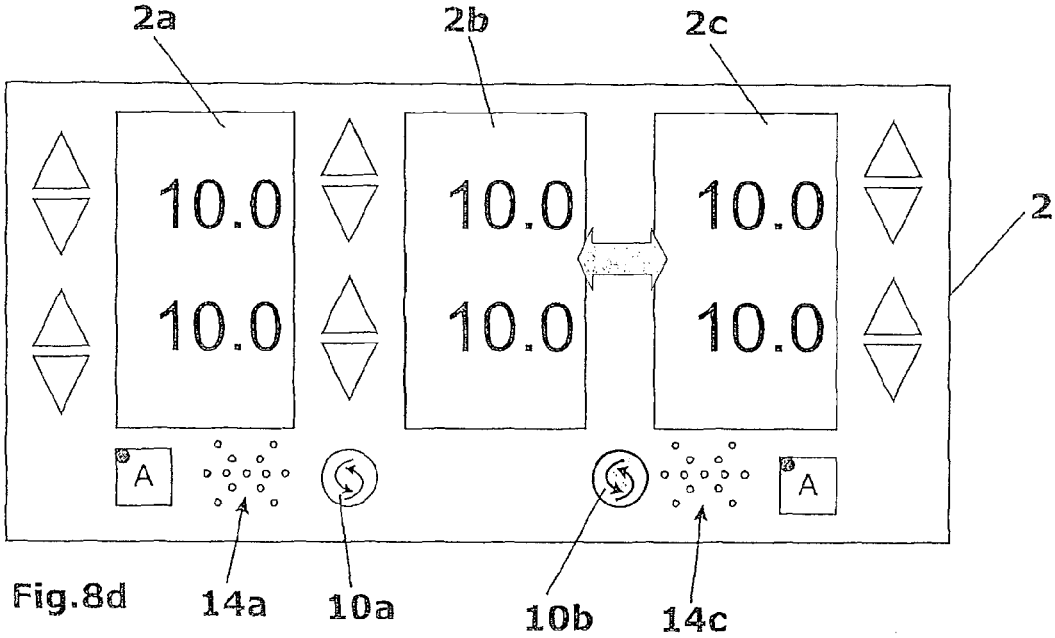

FIGS. 8*a* and 8*d* show an embodiment with matching of the actual values and set values.

The initial situation shown in FIG. 8*a* indicates, with regard to the controller 6*c* on the right side, the values of a milling depth sensor C, for example, a wire-rope sensor mounted at the edge protection, while the central indication and setting unit 2*b* indicates the values of a milling depth sensor B, for example, an ultrasonic sensor with scanning point in front of the milling drum.

The milling depth sensor C is to be replaced by the milling depth sensor B, where the set values and actual values of the two sensors B, C do not match. However, the current adjustment value equals 0, as is evident from the indication device 14*a*, 14*c*.

As sensor B is adjusted differently, its actual value does not match the actual value of sensor C. It can be equated to the actual value of sensor A by means of the actual value setting buttons 18 either manually or automatically, for example, by keeping the two actual value setting buttons 18 pressed for an extended period of time.

FIGS. 8*c* and 8*d* show the matching procedure of the set values. As the set value of the two sensors B, C relates to the milling depth on the right, the set value of sensor B is to be adapted to the set value of sensor C. This can be effected via set value setting buttons or automatically, for example, by keeping the two set value setting buttons pressed for an extended period of time.

Following actuation of the right switchover button 10*b*, the set value and actual value of sensor B are applied. The adjustment value remains 0 and is thus unchanged.

All embodiments indicate the set values and actual values of the pre-selected sensor B, which is to be exchanged for a previously used sensor C, in the indication and setting unit 2*b*. It is possible in this way to pre-set all setting values (set values and actual values) of the pre-selected sensor B, and to adapt them to the previously used sensors A, C or their set values or actual values respectively even prior to entering a switchover command via the switchover buttons 10*a* or 10*b*. Upon actuation of the switchover button 10*a* of the switchover device 10, the pre-selected sensor is exchanged with the sensor A that is currently used on the left side of the road construction machine 1.

As already explained before in connection with the embodiment of FIG. 7, instead of effecting equalization of the set values manually, equalization of the set values can also be effected automatically when actuating the switchover button 10*b* (or 10*a*) in automatic mode.

Although a preferred embodiment of the invention has been specifically illustrated and described herein, it is to be understood that minor variations may be made in the apparatus without departing from the spirit and scope of the invention, as defined by the appended claims.

What is claimed is:

1. A method of controlling at least one position characteristic of a milling drum of a road construction machine, the at least one position characteristic being from the group consisting of the milling depth of the drum and the slope of the drum, the method comprising:

(a) setting a set value for an operational parameter of at least one sensor, the operational parameter corresponding to at least one of the milling depth of the drum and the slope of the drum;

(b) conducting a milling operation;

(c) during the milling operation, sensing a current actual value of the operational parameter of the at least one sensor;

(d) generating an adjustment value with a controller, the adjustment value correlating to a difference between the set value and the current actual value of the operational parameter of the at least one sensor;

(e) controlling the at least one position characteristic based on the adjustment value;

(f) without interrupting the milling operation, switching over the control of the at least one position characteristic from control based at least in part on the at least one sensor to control based at least in part on a replacement sensor not included in the at least one sensor, and (g) setting a set value for the operational parameter of the replacement sensor to a current measured actual value of the operational parameter of the replacement sensor.

2. The method of claim 1, wherein:

in step (a) the at least one sensor includes two sensors; and in step (f) the replacement sensor replaces only one of the two sensors of step (a).

3. The method of claim 1, wherein:

in step (a) the at least one sensor includes only one sensor.

4. A method of controlling at least one position characteristic of a milling drum of a road construction machine, the at least one position characteristic being from the group consisting of the milling depth of the drum and the slope of the drum, the method comprising:

(a) setting a set value for an operational parameter of at least one sensor, the operational parameter corresponding to at least one of the milling depth of the drum and the slope of the drum;

(b) conducting a milling operation;

(c) during the milling operation, sensing a current actual value of the operational parameter of the at least one sensor;

(d) generating an adjustment value with a controller, the adjustment value correlating to a difference between the set value and the current actual value of the operational parameter of the at least one sensor;

(e) controlling the at least one position characteristic based on the adjustment value;

(f) without interrupting the milling operation, switching over the control of the at least one position characteristic from control based at least in part on the at least one sensor to control based at least in part on a replacement sensor not included in the at least one sensor, and (g) setting a current actual value for an operational parameter of the replacement sensor to a last measured actual value of the operational parameter of the at least one sensor.

5. A method of controlling at least one position characteristic of a milling drum of a road construction machine, the at least one position characteristic being from the group consisting of the milling depth of the drum and the slope of the drum, the method comprising:

(a) setting a set value for an operational parameter of at least one sensor, the operational parameter corresponding to at least one of the milling depth of the drum and the slope of the drum;

(b) conducting a milling operation;

(c) during the milling operation, sensing a current actual value of the operational parameter of the at least one sensor;

(d) generating an adjustment value with a controller, the adjustment value correlating to a difference between the set value and the current actual value of the operational parameter of the at least one sensor;

(e) controlling the at least one position characteristic based on the adjustment value;

(f) without interrupting the milling operation, switching over the control of the at least one position characteristic from control based at least in part on the at least one sensor to control based at least in part on a replacement sensor not included in the at least one sensor, and (g) in the event of a deviation of a measured actual value of the operational parameter of the replacement sensor from the measured actual value of the operational parameter of the at least one sensor at the time of switching over, altering the adjustment value in accordance with a transition function starting with the current adjustment value at the time of switching over.

6. A method of controlling at least one position characteristic of a milling drum of a road construction machine, the at least one position characteristic being from the group consisting of the milling depth of the drum and the slope of the drum, the method comprising:

controlling the at least one position characteristic based at least in part on a measurement made with a first sensor;

without interrupting the milling operation, switching over the control of the at least one position characteristic to control based at least in part on a measurement made with a second sensor; and setting a set value for an operational parameter of the replacement sensor to a current measured actual value of the operational parameter of the replacement sensor, the operational parameter corresponding to the at least one position characteristic.

7. A method of controlling at least one position characteristic of a milling drum of a road construction machine, the at least one position characteristic being from the group consisting of the milling depth of the drum and the slope of the drum, the method comprising:

controlling the at least one position characteristic based at least in part on a measurement made with a first sensor;

without interrupting the milling operation, switching over the control of the at least one position characteristic to control based at least in part on a measurement made with a second sensor; and setting a current actual value for an operational parameter of the replacement sensor to a last measured actual value of an operational parameter of the at least one sensor, the operational parameters corresponding to the at least one position characteristic.

8. A method of controlling at least one position characteristic of a milling drum of a road construction machine, the at least one position characteristic being from the group consisting of the milling depth of the drum and the slope of the drum, the method comprising:

controlling the at least one position characteristic based at least in part on a measurement made with a first sensor;

without interrupting the milling operation, switching over the control of the at least one position characteristic to control based at least in part on a measurement made with a second sensor; and in the event of a deviation of a measured actual value of an operational parameter of the replacement sensor from a measured actual value of an operational parameter of the at least one sensor at the time of switching over, the operational parameters corresponding to the at least one position characteristic, altering an adjustment value in accordance with a transition function starting with a current adjustment value at the time of switching over.

9. A road construction machine for the treatment of road surfaces, comprising:

a milling drum, the milling drum being position adjustable with regard to at least one position characteristic selected from the group consisting of milling depth of the drum and slope of the drum; and a leveling system configured to control the at least one position characteristic, the leveling system including:

a plurality of selectable sensors, each sensor configured to sense a current actual value of an operating parameter corresponding to at least one of the milling depth of the drum and the slope of the drum;

a plurality of indication and setting devices, each of the indication and setting devices being associable with at least one of the plurality of selectable sensors, each indication and setting device being operable to indicate the current actual value of and to set a set value for each operating parameter sensed by its associated sensor or sensors;

a controller and switchover system configured to control the at least one position characteristic conditioned on set value or values and sensed current actual value or values of the operating parameter or parameters sensed by a selected subset of the plurality of selectable sensors by returning at least one adjustment value to adjust the at least one position characteristic so that the sensed current actual value or values of the operating parameter or parameters approach the set value or values for the selected subset of the plurality of selectable sensors;

the controller and switchover system being configured to switch over from control based upon a first selected subset of the plurality of selectable sensors to control based upon a second selected subset during milling operation without interruption of the milling operation, the second selected subset exchanging at least one replacement sensor not in the first subset for at least one replaced sensor that was in the first subset; and wherein the controller and switchover system is operable to set a set value for an operating parameter for the replacement sensor to the current actual value for the operating parameter of the replacement sensor.

10. The road construction machine of claim 9, wherein:

the controller and switchover system includes first and second control units operably associated with first and second sensors, respectively, of the plurality of selectable sensors, the first and second sensors being arranged parallel to a rotational axis of the milling drum, the first and second control units being operable to control milling depth of the milling drum independently of one another on left and right sides, respectively, of the road construction machine.

11. The road construction machine of claim 9, wherein:

the plurality of selectable sensors includes:

a first sensor being a left side depth sensor;

a second sensor being a right side depth sensor; and a third sensor being a third depth sensor;

the first subset of sensors includes only two of the first, second and third sensors; and the second subset of sensors includes the other one of the first, second and third sensors not in the first subset, and the second subset of sensors includes only one of the two sensors of the first subset of sensors.

12. The road construction machine of claim 9, wherein:

the plurality of selectable sensors includes a first sensor and a second sensor;

the first subset of sensors includes the first sensor but not the second sensor; and the second subset of sensors includes the second sensor but not the first sensor.

13. The road construction machine of claim 12, wherein:

the plurality of selectable sensors includes only the first and second sensors.

14. The road construction machine of claim 12, wherein:

the plurality of selectable sensors further includes a third sensor.

15. A road construction machine for the treatment of road surfaces, comprising:

a milling drum, the milling drum being position adjustable with regard to at least one position characteristic selected from the group consisting of milling depth of the drum and slope of the drum; and a leveling system configured to control the at least one position characteristic, the leveling system including:

a plurality of selectable sensors, each sensor configured to sense a current actual value of an operating parameter corresponding to at least one of the milling depth of the drum and the slope of the drum;

a plurality of indication and setting devices, each of the indication and setting devices being associable with at least one of the plurality of selectable sensors, each indication and setting device being operable to indicate the current actual value of and to set a set value for each operating parameter sensed by its associated sensor or sensors;

a controller and switchover system configured to control the at least one position characteristic conditioned on set value or values and sensed current actual value or values of the operating parameter or parameters sensed by a selected subset of the plurality of selectable sensors by returning at least one adjustment value to adjust the at least one position characteristic so that the sensed current actual value or values of the operating parameter or parameters approach the set value or values for the selected subset of the plurality of selectable sensors;

the controller and switchover system being configured to switch over from control based upon a first selected subset of the plurality of selectable sensors to control based upon a second selected subset during milling operation without interruption of the milling operation, the second selected subset exchanging at least one replacement sensor not in the first subset for at least one replaced sensor that was in the first subset; and wherein the controller and switchover system is operable to set a current actual value for an operating parameter for the replacement sensor to a last measured actual value for the operating parameter of the replaced sensor.

16. A road construction machine for the treatment of road surfaces, comprising:

a milling drum, the milling drum being position adjustable with regard to at least one position characteristic selected from the group consisting of milling depth of the drum and slope of the drum; and a leveling system configured to control the at least one position characteristic, the leveling system including:

a plurality of selectable sensors, each sensor configured to sense a current actual value of an operating parameter corresponding to at least one of the milling depth of the drum and the slope of the drum;

a plurality of indication and setting devices, each of the indication and setting devices being associable with at least one of the plurality of selectable sensors, each indication and setting device being operable to indicate the current actual value of and to set a set value for each operating parameter sensed by its associated sensor or sensors;

a controller and switchover system configured to control the at least one position characteristic conditioned on set value or values and sensed current actual value or values of the operating parameter or parameters sensed by a selected subset of the plurality of selectable sensors by returning at least one adjustment value to adjust the at least one position characteristic so that the sensed current actual value or values of the operating parameter or parameters approach the set value or values for the selected subset of the plurality of selectable sensors;

the controller and switchover system being configured to switch over from control based upon a first selected subset of the plurality of selectable sensors to control based upon a second selected subset during milling operation without interruption of the milling operation, the second selected subset exchanging at least one replacement sensor not in the first subset for at least one replaced sensor that was in the first subset; and wherein the controller and switchover system is operable, in the case of a difference between a current actual value of an operating parameter for the replacement sensor and the current actual value of the operating parameter of the replaced sensor, to alter the at least one adjustment value in accordance with a pre-settable transition function.

17. A leveling device for a position adjustable milling drum of a road construction machine, the milling drum being position adjustable with regard to at least one position characteristic selected from the group consisting of milling depth of the drum and slope of the drum, the leveling device comprising:

a plurality of selectable sensors, each sensor configured to sense a current actual value of an operating parameter corresponding to at least one of the milling depth of the drum and the slope of the drum;

a plurality of indication and setting devices, each indication and setting device being operable to indicate the current actual value of and to set a set value for the operating parameter sensed by at least one sensor of the plurality of selectable sensors;

a controller and switchover system configured to control the at least one position characteristic conditioned on set value or values and sensed current actual value or values of the operating parameter or parameters sensed by a selected subset of the plurality of selectable sensors by returning at least one adjustment value to adjust the at least one position characteristic so that the sensed current actual value or values of the operating parameter or parameters approach the set value or values for the selected subset of the plurality of selectable sensors;

the controller and switchover system being configured to switch over from control based upon a first selected subset of the plurality of selectable sensors to control based upon a second selected subset during milling operation without interruption of the milling operation, the second selected subset exchanging at least one replacement sensor not in the first subset for at least one replaced sensor that was in the first subset; and wherein the controller and switchover system is operable to set a set value for an operating parameter for the replacement sensor to the current actual value for the operating parameter of the replacement sensor.

18. A leveling device for a position adjustable milling drum of a road construction machine, the milling drum being position adjustable with regard to at least one position characteristic selected from the group consisting of milling depth of the drum and slope of the drum, the leveling device comprising:

a plurality of selectable sensors, each sensor configured to sense a current actual value of an operating parameter corresponding to at least one of the milling depth of the drum and the slope of the drum;

a plurality of indication and setting devices, each indication and setting device being operable to indicate the current actual value of and to set a set value for the operating parameter sensed by at least one sensor of the plurality of selectable sensors;

a controller and switchover system configured to control the at least one position characteristic conditioned on set value or values and sensed current actual value or values of the operating parameter or parameters sensed by a selected subset of the plurality of selectable sensors by returning at least one adjustment value to adjust the at least one position characteristic so that the sensed current actual value or values of the operating parameter or parameters approach the set value or values for the selected subset of the plurality of selectable sensors;

the controller and switchover system being configured to switch over from control based upon a first selected subset of the plurality of selectable sensors to control based upon a second selected subset during milling operation without interruption of the milling operation, the second selected subset exchanging at least one replacement sensor not in the first subset for at least one replaced sensor that was in the first subset; and wherein the controller and switchover system is operable to set a current actual value for an operating parameter for the replacement sensor to a last measured actual value for the operating parameter of the replaced sensor.

19. A leveling device for a position adjustable milling drum of a road construction machine, the milling drum being position adjustable with regard to at least one position characteristic selected from the group consisting of milling depth of the drum and slope of the drum, the leveling device comprising:

a plurality of selectable sensors, each sensor configured to sense a current actual value of an operating parameter corresponding to at least one of the milling depth of the drum and the slope of the drum;

a plurality of indication and setting devices, each indication and setting device being operable to indicate the current actual value of and to set a set value for the operating parameter sensed by at least one sensor of the plurality of selectable sensors;

a controller and switchover system configured to control the at least one position characteristic conditioned on set value or values and sensed current actual value or values of the operating parameter or parameters sensed by a selected subset of the plurality of selectable sensors by returning at least one adjustment value to adjust the at least one position characteristic so that the sensed current actual value or values of the operating parameter or parameters approach the set value or values for the selected subset of the plurality of selectable sensors;

the controller and switchover system being configured to switch over from control based upon a first selected subset of the plurality of selectable sensors to control based upon a second selected subset during milling operation without interruption of the milling operation, the second selected subset exchanging at least one replacement sensor not in the first subset for at least one replaced sensor that was in the first subset; and wherein the controller and switchover system is operable, in the case of a difference between a current actual value of an operating parameter for the replacement sensor and the current actual value of the operating parameter of the replaced sensor, to alter the at least one adjustment value in accordance with a pre-settable transition function.

* * * * *